United States Patent [19]

Märkl

[11] 4,329,677

[45] May 11, 1982

[54] SIGNAL-LIGHT SYSTEMS, ESPECIALLY FOR A SERIES OF EMERGENCY-PHONE STATIONS DISTRIBUTED ALONG THE LENGTH OF A HIGHWAY, OR THE LIKE

[75] Inventor: Georg Märkl, Nuremberg, Fed. Rep. of Germany

[73] Assignee: Te Ka de Felten & Guilleaume Fernmeldeanlagen GmbH, Nuremberg, Fed. Rep. of Germany

[21] Appl. No.: 55,005

[22] Filed: Jul. 5, 1979

[30] Foreign Application Priority Data

Aug. 7, 1978 [DE] Fed. Rep. of Germany ..... 2830064

[51] Int. Cl.[3] ..... G08B 5/00; H05B 41/00

[52] U.S. Cl. ..... 340/84; 340/81 R; 340/87; 340/331; 315/200 A; 315/201; 315/252; 315/312

[58] Field of Search ..... 340/84, 81 R, 82, 83, 340/87, 114 R, 114 B, 331, 332, 41 R, 32, 35, 538, 534; 315/200 R, 200 A, 201, 250, 252, 272, 312, 314, 317-319, 324, 325, 326, 352, 353, 354, 355, 360, 361

[56] References Cited

U.S. PATENT DOCUMENTS

| | | | |
|---|---|---|---|
| 3,206,721 | 9/1965 | Rudden et al. | 340/35 |
| 3,251,030 | 5/1966 | Bolton et al. | 340/41 |
| 3,414,878 | 12/1968 | Smith | 340/41 |
| 3,488,558 | 1/1970 | Crafton | 340/83 |
| 3,925,704 | 12/1975 | Camic | 340/82 |
| 3,973,168 | 8/1976 | Kearsley | 340/331 |
| 4,185,232 | 1/1980 | Ingalls et al. | 340/331 |

*Primary Examiner*—John W. Caldwell, Sr.
*Assistant Examiner*—Donnie Lee Crosland
*Attorney, Agent, or Firm*—Michael J. Striker

[57] ABSTRACT

Emergency phone stations distributed at intervals of 1 or 2 km along a highway area and connected to a communications channel with a power line. Each phone station has a set of flash lamps which can be blinked in accordance with differing blinking schedules, and with a storage capacitor which stores flash energy. When a lamp is flashed, the storage capacitor discharges from the power line, the charging time-constant of each station being different due to differing distances from a central station. To impose an order on the network, central clocking is employed, with lamp ignitions occurring at each individual station being referenced to clocking signals common to all stations, so that the blinking schedules at all activated stations have a fixed phase interrelationship. This predetermines the times and sequences at which the storage capacitors will recharge. All storage capacitors are identical and are so selected that $t_0/R.C_{ges}=0.5$ to 3, preferably 1.25, $t_0$ being the charging time allotted, $C_{ges}$ being the combined capacitance of the maximum number of stations which can be simultaneously flashed, and R being the charging resistance to the most distant station. This transfers maximum energy to the storage capacitors. The recharging of each storage capacitor is discontinued when a predetermined amount of energy has been accumulated. Flash energies at the nearest and most remote stations are thus equalized.

14 Claims, 18 Drawing Figures

| NRS | I | II | III | II' | III' |
|---|---|---|---|---|---|
| CONTACT a | • | • | • | | |
| b | • | | | | |
| c | | • | | | |
| d | | | • | | |
| e | | | • | | |
| f | | | | • | • |
| g | | | | • | |
| h | | | | | • |
| i | | | | | • |

SIGNAL-LIGHT SYSTEMS, ESPECIALLY FOR A SERIES OF EMERGENCY-PHONE STATIONS DISTRIBUTED ALONG THE LENGTH OF A HIGHWAY, OR THE LIKE

BACKGROUND OF THE PRESENT INVENTION

The present invention concerns signal-light systems, most especially those provided along roads and highways. It is known to provide emergency-phone stations at intervals along the length of a highway, the emergency-phone stations being distributed along the length of a communications cable laid along the length of such highway. Sometimes, such emergency-phone stations are provided with signal-light systems. For example, each emergency-phone station in a series of such stations may be provided with an electronic flash lamp which, from a remote central station, is caused to blink, to warn drivers that they are approaching the site of an accident, or the like. An operator at the remote central station selects which emergency-phone stations are to have their respective flash lamps blink, and the power needed to effect flashing of the flash lamps is transmitted to the activated emergency-phone stations via a power-supply line which runs along the communications cable and which supplies operating power to electrical equipment at such emergency-phone stations. The flash lamp at each such emergency-phone station is provided with a storage capacitor which serves as the power source for the respective flash lamp, with the storage capacitor being energized from the aforementioned power-supply line.

Federal Republic of Germany published allowed patent application DE-AS No. 19 33 436 discloses a blinking-light highway signalling system of this type. The moment at which the electronic flash lamp at a particular emergency-phone station will flash, and indeed each moment at which it will flash during its blinking, is determined by the instantaneous state of charge of the storage capacitor provided at that emergency-phone station. This manner of timing the flashes of the blinking action, i.e., in dependence upon the instantaneous state of charge of the associated storage capacitor, has been provided for systems in which each emergency-phone station is provided with only a single flash lamp.

However, more complicated versions of such highway blinking-light signalling systems have been sought, in which the signalling of a traffic hazard, or the like, involves a series of such emergency-phone stations, the blinking-light actions at successive ones of which are different and distinguishable from one another with respect both to the number of lamps flashing at successive stations and also with respect to the rate of blinking at different stations. For example, in the case of an upcoming traffic-accident site, a first activated emergency-phone-station blinking-light system may have only one of its flash lamps in blinking operation, the next station closer to the accident site have two of its lamps blinking, and the following station closest to the accident site having three of its lamps blinking, to provide information in the form of a subjective effect of increasing urgency, and with the rates and sequences at which the lamps at successive activated stations blink perhaps likewise differing, likewise to contribute to the subjective effect of increasing urgency.

Attempts to implement more informative signal-light actions of this kind become problematic, when reliance is to be had on conventional charge-dependent timing action, i.e., when the moment at which each flash lamp is flashed during the course of blinking action is determined by the instantaneous state of charge of an associated storage capacitor. In addition to the complexity inherent in the more complex signal-light action just described, the series of emergency-phone stations which are to be activated to provide such a multi-station blinking action will, necessarily, comprise stations located at differing distances from the remote central station from which power is supplied. Furthermore, the distance from the central station to the nearest one of the series of activated stations may be similar to that of the farthest activated stations, if the series of activated stations is far from the central station, whereas if the series of activated stations is near the central station, the distance from the central station to the farthest of these may be a multiple of the distance to the nearest of these, and so forth. All this taken together makes for a capacitive charging network which is not only complicated in configuration but whose configuration furthermore changes from one instance of use to the next.

For these reasons, the charge-dependent flash-timing action of the DE-AS No. 19 33 436 mentioned above cannot be used for so complicated and furthermore changing a capacitive charging network; mainly, the various time constants involved would change from one instance of use to another, and indeed would change even within the course of a single instance of use. This conventional approach to flash-timing action would, with the complex blinking-lamp signalling actions here in question, lead to results extending anywhere from irregular and uncontrollable interflash intervals up to total failure of some flash lamps to be fired at all, i.e., due to failure of their storage condensors to achieve an operative voltage level.

Adding somewhat to such complications is the fact that the power transmittable via the power line which will already be provided along such a succession of emergency-phone stations is low. In order to be able to transmit to the storage condensor at each such station the amount of energy needed for each flash, it is therefore not possible to employ a charging time whose duration is lower than a certain minimum. This at least tends to make the minimum interval between successive flashes at any given station incapable of being short enough to implement the quick-flash action needed to attract the attention of, or indeed even be perceivable to, the drivers of vehicles travelling at high speed along such a highway.

SUMMARY OF THE INVENTION

It is a general object of the invention to provide a complex flashing-light highway signalling system of the type discussed above, but of such a nature that the complicated flashing-light signalling actions referred to above can be implemented, reliably and with definiteness.

It is a related object to be able to transmit to the storage capacitors of the stations a rather high amount of energy for the flashes to be produced, despite the limitations which are faced with regard to the amount of power transmittable along the available power-supply line, with regard to the resistance presented by the available power-supply line, and despite the limited time interval available for each such storage-capacitor charging operation, i.e., this time interval being limited by the need for short interflash intervals in order to establish relatively high flashing rates.

It is a further related object to be able to flash the various flash lamps of the series of stations selected for a particular signalling action with differing but completely predeterminable flashing rates, despite the fact that the time constants of each different selected series of stations may differ and furthermore differ among themselves.

In the preferred embodiment of the invention, the capacitances of the storage capacitors provided at the emergency-phone stations are so selected that the total capacitance $C_{ges}$ of the condensors of the maximum number of stations which are to participate in a complex flashing-light signalling action form, with the line resistance R between the remote central station which powers these stations and the station most distant therefrom, results in a charging time-constant $T=R\times C_{ges}$, such that the ratio $t_0/T$, $t_0$ being the available charging interval, be between 0.5 and 3, preferably about 1.25. For reasons explained in detail below, this relationship serves, in the particular type of configuration here in question and in the context of the particular types of system limitations involved, to maximimize the energy which can be transferred to the storage condensors of the stations using the lines and time intervals which need be coped with.

In the preferred embodiment of the invention, each storage condensor is provided with respective means for limiting the amount of energy which the condensor can store, by interrupting charging of the condenser as soon as a predetermined amount of charge has been accumulated. This makes it possible in a way which, although different from conventional practice is actually simpler, to deal with the large number of different combinations of capacitor-charging time-constants involved in the differently located stations and in their differing combinations, so as to be able to somewhat equalize and make highly predetermined both the nature of the charging action occurring at each station individually and also, to a great degree, the nature of the charging action occurring as a whole for the selected series of stations.

In the preferred embodiment of the invention, the firing of the various flash lamps is performed independently of the state of charge of their respective storage condensors, not in exclusive dependence thereon as in prior art. This approach in itself serves to overcome some of the difficulties involved when so many different time-constants and combinations of time-constants are involved, and furthermore opens up certain avenues of approach for dealing with various others of the problems which such time-constant complexity presents when complicated flashing-lamp signalling schemes of the type here in question are to be implemented.

When each emergency-phone station is provided with a set of flash lamps, and the individual flash lamps of the set are to be flashed at differing rates, and/or in differing combinations, and/or in differing sequences, then within each set considerations of relative timing are of course important, especially when certain flashing-light effects are to be achieved, e.g., sequential flashing of all the flash lamps of the set. In contrast, there is, for purposes of the psychological or informative effect to be attained, no need to establish fixed or synchronized correlations between, on the one hand, the flashing schedule followed at one station in the series of activated stations and, on the other hand, the flashing schedule followed at the next-following stations; among other things, the successive stations may be so distant from each other that the driver of a vehicle will not be able to see more than one of these stations at a time.

Nevertheless, in accordance with a further concept of the invention, resort is had to a synchronization or central clocking technique, to which are referenced all moments at which flashing occurs, and therefore the starts and ends of all interflash intervals, at all flash lamps of each individual station, and at all flash lamps of all stations in a series of activated stations. Although such a synchronization or central clocking technique is not needed per se for the display effects to be implemented, it constitutes a singularly effective approach to the confusion presented by the various time-constants and combinations of time-constants of the system. When the instants at which flashing can occur at any and all lamps of any and all stations are predetermined in accordance with a central clocking action, and the various flash schedules to be implemented are all organized or constructed in terms of a central clocking interval and/or multiples of such interval, this serves to impose upon the confusion of the multiple-time-constant system a certain basic order, with respect to which then deviations from ideal timing action or the possibility of ideal timing action can be attacked and compensated for by various means of a relatively simple to implement character, not involving exhausting predetermination of all the time-constant relationships and combinations of relationships which such a multiple-time-constant system otherwise presents to the designer. Likewise, as explained in greater detail below, when this basic order is imposed upon the system, the nature of the means which can then be used to overcome the remaining problems presented by multiple-time-constant behavior can be overcome in a way which permits the circuitry of all stations to be identical. It is emphasized that this approach stands in great contrast to prior-art efforts, in accordance with which attempts have been made to analyze and compensate in advance all the time-constant situations which might develop, and according to which the results of the compensation generally lead to non-identical station circuitry. At its worst, prior-art thinking, if applied to more ambitious flash-lamp signalling actions such as here contemplated, necessitates completion of design of the system, i.e., in the sense of complex and interrelated adjustments, after the system has been physically installed, and the adjustments and interrelated compensations which would be needed with prior-art approaches would be, among other things, difficult to comprehend in the context of subsequent maintenance and repair work.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
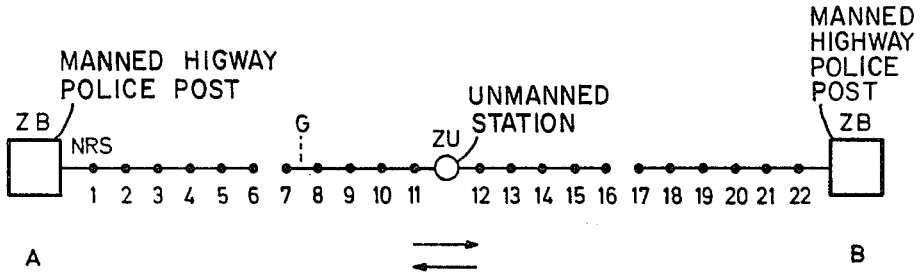
FIG. 1 schematically represents the stretch of cable between two manned highway police posts and a succession of emergency-phone stations connected at intervals to such cable.

FIG. 1 depicts a succession of emergency-phone stations, denoted NRS1-NRS22 spaced at intervals of about 2 kilometers each, between a manned highway police post ZB at a location A and another such post at location B. The manned posts ZB are referred to as central stations, for reasons which will become apparent. The emergency-phone stations NRS1-NRS22 are connected at intervals to a communications line which extends between the two manned posts ZB. The electrical power needed to operate the circuitry provided at the emergency-phone stations is transmitted to stations NRS1-6 from the central station ZB at location A, to stations NRS17-22 from the central station ZB at location B, and to stations NRS7-16 from an unmanned central station ZU. The power-supply lines from the manned stations ZB and from the unmanned station ZU are separate electrical circuits, as indicated by the gaps between stations NRS6 and NRS7, and between stations NRS16 and NRS17; in contrast, the communications channel to which the stations NRS1-22 are at intervals connected extends all the way between the central stations ZB at locations A and B, although this is not explicitly shown in the drawing, the power-supply lines being of interest. In certain conventional setups of this type, each power-supply line comprises two pairs of conductors. One pair of conductors is used to supply A.C. voltage to an exterior light at the emergency-phone station; the other pair of conductors has been conventionally used to supply A.C. voltage to a small lamp located in the emergency-phone mouthpiece to illuminate an indicium identifying the emergency-phone station by kilometer number, i.e., so that the user of the phone can inform highway police of his location. In FIG. 1, for the sake of simplicity, these two pairs of conductors are represented by a single power-supply line.

Likewise, whereas in FIG. 1 only a single succession of emergency-phone stations NRS1-22 is depicted, e.g., extending along one of the two sides of a highway, typically another such succession of phone stations is provided along the opposite-traffic-direction side of the highway. Accordingly, in FIG. 1, e.g. NRS4 denotes two emergency-phone stations, one located at the side of the highway of traffic travelling in the direction from A to B, the other at the side of the highway for traffic going in the direction from B to A; this is indicated by the two, oppositely pointed arrows in FIG. 1. The emergency-phone stations at both sides of the highway are connected to a common cable, a so-called omnibus line. This cable is laid along only one side of the highway, and the emergency-phone stations at the opposite side of the highway are connected to this cable by means of cross lines.

The transmission of voltage and current for the flashing-lamp highway signalling system is effected by means of a phantom circuit. Such phantom circuit may, for example, be formed from the two pairs of conductors used to energize the aforementioned exterior lights and the aforementioned lights for the kilometer indicia. The principle of phantom circuits utilizing center-tapped inductors or so-called phantom transformers is too well known in the electrical arts to require detailed explanation here.

The phantom circuit is used not only to transmit flash energy to the set of flash lamps with which each emergency-phone station is provided, but is additionally used to transmit code signals from the central stations to the various phone stations. The transmitted code signals serve, first, to identify which phone stations are to have their flashing-lamp systems activated, and serve, second, to identify what blinking schedule is to be followed at each activated station. Either the code signals are directly transmitted from a manned central station ZB to the emergency-phone stations, or else they are transmitted indirectly, first to the unmanned central station ZU and then to the emergency-phone stations. In the latter case, the code signals are converted, at the manned central station, into a form suitable for data transmission, then transmitted via the throughgoing communications cable to the unmanned central station, there converted back into their original form, and then transmitted to the emergency-phone stations. The code signals may be constituted by a series of pulsed A.C. voltage representing data by resort to a plurality of different voltage amplitudes. The code signals may additionally be used to actually supply the operating power to the evaluating circuitry with which each phone station is provided for the recognition of the code signals.

Figure 2:
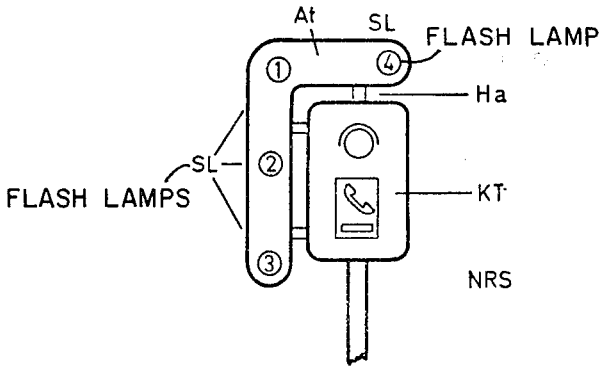
FIG. 2 depicts the appearance of an exemplary emergency-phone station, such as provided at intervals along the stretch of cable of FIG. 1.
Figure 4:
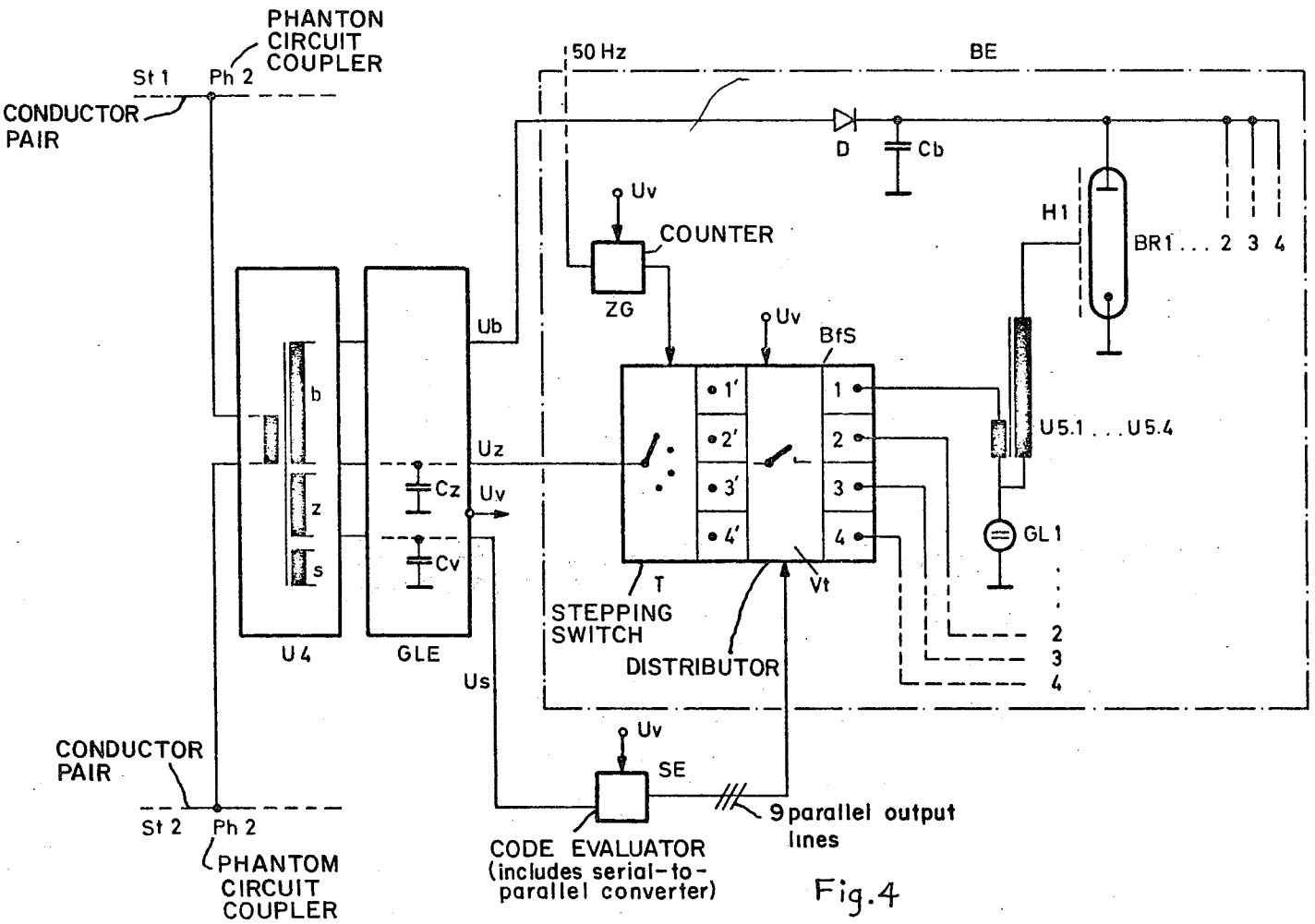
FIG. 4 is a schematic, overall block diagram of the flash-control circuitry provided at each individual one of the emergency-phone stations.

Each emergency-phone station is provided with a flashing-lamp signalling subsystem comprised of four electronic flash lamps BR1-BR4 (cf. FIG. 4). These form parts of the four signal lamps SL1-SL4 (cf FIG. 2) provided at each phone station. Each set of four signal lamps SL1-SL4 is, as shown in FIG. 2, provided on an L-shaped bracket structure. At mounted by a mounting arrangement Ha on the head part KT of the respective phone station NRS. Structurally, the L-shaped disposition of the four signal lamps SL1–SL4 serves to shorten the effective lever arm which the mounting structure for the lamps presents to wind; also, the L-shaped organization can implement certain display effects explained below.

When a series of immediately successive phone stations is selected for activation, e.g., to warn of an upcoming traffic hazard or the like, in the preferred form of the invention the first station of the selected series of consecutive stations flashes only one of its four signal lamps SL1–SL4, the next, two of its signal lamps, and so forth, to create a subjective effect of increasing urgency or increasing closeness to the hazard being warned of.

Figure 3A:
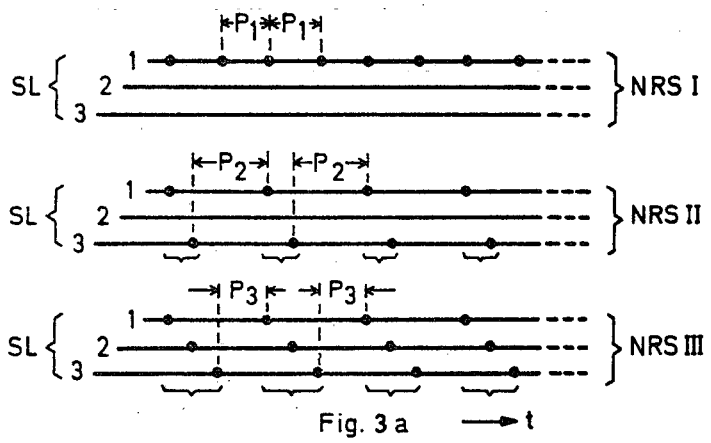
FIG. 3*a*-3*e* are explanatory diagrams referred to in the course of explanation of various flashing-lamp signalling actions.

FIG. 3*a* depicts the blinking schedules followed at three successive phone stations selected for the warning of a traffic hazard; it will be understood that the use of exactly three successive stations is merely one possibility. In FIG. 3*a*, the bracketed section denoted NRSI denotes the first station in the series of three activated stations, NRSII the next of the three activated stations, and NRSIII the third of the activated stations. At the bracketed section NRSI, the bracketed indication SL 1, 2, 3 at the left indicates three of the four signal lamps SL1–SL4 provided at station NRSI. The moments in time, measured along the t-axis, at which the signal lamps of each of the stations NRS-NRSIII flash are indicated by dots.

Figure 3B:
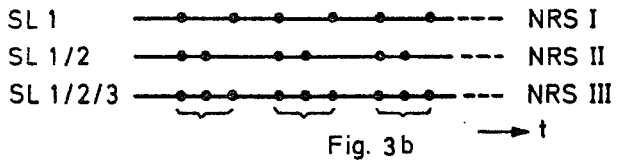

In FIG. 3*a*, at emergency-phone station NRSI only one signal lamp SL1 blinks at intervals $P_1$. At the next station NRSII, i.e., considered in the direction of traffic flow towards the hazard, only the two signal lamps SL1 and SL3 blink; first SL1 flashes, then lamp SL3 flashes, then an interflash interval of duration $P_2$ passes before lamp $SL_1$ again flashes; and so forth. At station NRSIII, the three signal lamps SL1–SL3 flash consecutively in numerical order, with an overall interflash interval of duration $P_3$. The flashing schedule depicted in FIG. 3*a* for station NRSIII is depicted, in a different form of representation, in FIG. 3*d*, the downwardly pointing arrow t indicating the sequence in which the three signal lamps SL1–SL3 consecutively (and repeatedly) flash. In FIGS. 3*d* and 3*e*, those lamps which flash are indicated by hatched circles.

FIG. 3*d* depicts, in a different digrammatic manner, the same flashing schedules as depicted in greater detail in FIG. 3*a*. In the form of representation used in FIG. 3*b*, and used elsewhere below, the dots along each single horizontal line represent the instants at which a flash is produced at a particular phone station, with an indication provided, at the left of the Figure, of which flash lamps are being flashed at each such station represented; this form of representation is utilized below, in the course of discussion of energization problems considered apart from from the psychological or display aspects of the flash schedules involved.

Figure 3C:
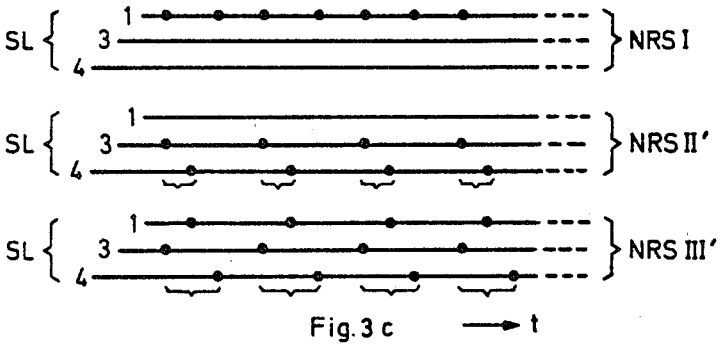
Figure 3D:
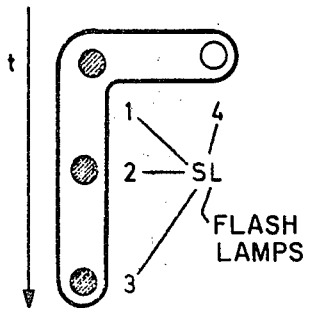
Figure 3E:
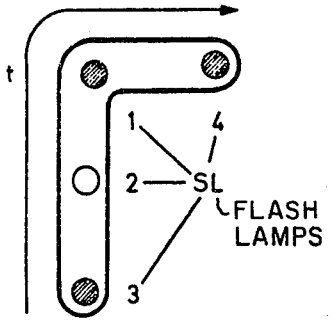

FIG. 3*c* diagrammatically depicts a different flashing schedule intended to instruct drivers to exit the highway, e.g., because an upcoming accident site is unpassable. As indicated at the left in FIG. 3*c*, only the signal lamps SL1, SL3, SL4 are utilized for this flash schedule. The flash schedule followed at first phone station NRSI is actually the same as in FIG. 3*a*, and therefore the first station is again denoted NRSI: only signal lamp SL1 blinks. The flash schedules followed at the second and third stations are altered relative to those of FIG. 3*a*, and therefore these two stations are here denoted NRSII′ and NRSIII′. At second station NRSII′, only signal lamps SL3 and SL4 blink. At third station NRSIII′, signal lamps SL3, SL1 and SL4 blink, in the stated order. FIG. 3*e* depicts, by means of the L-shaped arrow t, the flashing effect occurring at station NRSIII′.

FIGS. 3*d* and 3*e* are provided to depict the different psychological or suggestive effect provided by the alternative flashing schedules followed at the third phone station of the selected series of three activated stations.

In the concrete examples just presented, the flash schedules followed at successive ones of the series of activated stations differ from each other not only with respect to the number of signal lamps flashing at each station, but furthermore with regard to the overall flashing rate prevailing at each station: e.g., in FIG. 3*a*, the number of flashes produced at each station intermediate the respective interflash intervals $P_1$ or $P_2$ or $P_3$ differs from one station to the next. This can be seen for the example of FIG. 3*a* somewhat more clearly in the different mode of diagrammatic representation employed in FIG. 3*b*, where the overall rate of flashing at each station NRSI, NRSII, NRSIII is more clearly emphasized.

Depending upon the nature of the hazard involved it may be appropriate to activate a series of stations at one side of the highway only, e.g., in the case of a traffic accident or a traffic jam, or it may be appropriate to activate a series of stations at both sides of the highway, e.g., in the case of a localized stretch of fog, a localized region of road-icing, etc. If for example in FIG. 1 the hazard location G is constituted by a localized region of road-icing, then those stations NRS5–7 which are at the side of the highway for travel in the A-B direction are activated, and also those stations NRS10–8 which are at the side of the highway for travel in the B-A direction. As will be explained further below, each emergency-phone station, or more precisely the flashing-lamp subsystem thereof, is individually selectable by means of an address signal, so that it be possible to activate the flashing-lamp subsystems at selected stations at one and/or the other side of the highway, despite the fact that all the phone stations at both sides of the highway are connected to a common cable.

FIG. 4 depicts the flash-lamp subsystem and the control circuitry therefor provided at one such emergency-phone station NRS: the configuration of the flash-lamp subsystem and control circuitry therefor is the same at each of the stations NRS. The aforementioned first pair of conductors St1 and the aforementioned second pair of conductors St2 constitute side circuits which together serve to form a phantom circuit. These two side circuits are used to transmit code signals to the emergency-phone stations, i.e., to select the particular stations whose flashing-lamp subsystems are to be activated for a particular instance of use, and to select the flash schedule to be followed at each of the activated stations. Additionally, as described below, the energy needed to power some of the circuitry at each station is derived from the code signals themselves. The code signals are abstracted from the side circuits St1, St2 using phantom-circuit couplers Ph2 and are applied to the primary winding of a transformer U4 provided with three secondary windings s, z and b. The voltage produced across secondary winding s is applied to a rectifier and charging stage GLE (depicted in detail in FIG. 7), rectified and transmitted in the form of a code-signal voltage Us to a code-evaluator stage SE. The code-signal voltage developed is, as already indicated, of fairly high energy, and is utilized to charge a current-source condensor Cv. Current-source condensor Cv serves as a current source for the various circuit stages which control the flashing action at the station involved, furnishing an operating voltage Uv to stages SE, ZG and BfS. The actions just referred to will be explained in greater detail with regard to FIG. 7.

As explained in greater detail below, each code signal comprises an address signal which picks out a station to be activated and also a schedule signal which determines what flashing schedule is to be implemented at that station. The schedule signal is processed by code-evaluator stage SE, and the latter produces at its output data implementing the flashing schedule to be followed. Code-evaluator stage SE includes a conventional serial-to-parallel converter, which converts the serially arriving bits of the schedule signal into parallel form at the output of stage SE; this is indicated in FIG. 4 by the plural-wire output symbol on the output line which leads from stage SE to the distributor stage Vt of a flash-schedule circuit stage Bfs. The parallel data at the output of code-evaluator stage SE controls the operation of the distributor stage Vt of flash-schedule circuit stage Bfs by establishing differing combinations of connections as between terminals 1, 2, 3, 4 and 1', 2', 3', 4' of stage Bfs. After these terminal connections are once established, they remain established until disestablished. After the code signals have been received and the requisite terminal connections have been established, the actual blinking action commences. During blinking action, current-source condensor Cv is continually replenished with charge, so that the circuit stages SE, BfS and ZG be continually supplied with operating voltage.

The actual flash energy needed for the flash or blinking action is likewise transmitted along the phantom circuit via the side circuits St1 and St2. The voltage supplied by the latter is stepped up across secondary winding b of transformer U4, rectified in the rectifier and charger stage GLE, and applied in the form of an appropriate flash voltage Ub to the four flash lamps BR1–BR4 of the flash-lamp subsystem BE of the emergency-phone station. The flash voltage Ub is smoothened by a condensor Cb. A charging diode D prevents backflow of charge from the charged condensor Cb.

The flash-schedule circuit stage Bfs comprises a stepping switch T, which is controlled by a counting stage ZG. The counting stage ZG counts 50-Hz half-cycles of, for example, the voltage supplied to the phone stations's exterior light or of the voltage supplied to the kilometer-indicator light of the stations's mouthpiece. Each time counting stage ZG has counted a predetermined number of supply-voltage half-cycles, it advances stepping switch T by one step, to make contact with terminals 1', 2', 3', 4' in cyclical sequence. The voltage developed across the secondary winding z of transformer U4 is used to charge a firing condensor Cz, and the voltage Uz developed across the latter constitutes the firing voltage used to fire the flash lamps BR1–BR4. Firing voltage Uz is applied to the input terminal of stepping switch T, for successive application to terminals 1', 2', 3', 4'.

Depending upon which of terminals 1, 2, 3, 4 have had connections established by distributor Vt to which terminals 1', 2', 3', 4', the firing voltage Uz is applied in the requisite sequence to successive ignition transformers U5.1, U5.2, U5.3, U5.4. Associated with each of these ignition transformers is a respective one of four glow lamps GL1–4 and a respective one of the firing electrodes H1, H2, H3, H4 of the four electronic flash lamps BR1, BR2, BR3, BR4. For the sake of simple illustration, only one glow lamp GL1 is depicted in FIG. 4, the others being indicated by their reference numerals, and likewise only flash lamp BR1 is depicted, the others being indicated by their reference numerals. When the firing voltage Uz is applied to ignition transformer U5.1, glow lamp GL1 is fired and, in conventional manner, through the intermediary of the high-voltage secondary winding of ignition transformer U5.1 and the firing electrode H1, and in cooperation with the flash voltage Ub applied across the two main electrodes of flash lamp BR1, effects firing of the latter. The firing of the other flash lamps is performed in the same way.

The firing method employed in FIG. 4 is externally triggered firing. This is in contrast to the usual method employed in such highway flash-lamp signalling systems (cf., e.g., DE-AS No. 19 33 436 mentioned above), according to which the moment of ignition is determined exclusively by the instantaneous state of charge of each flash lamp's storage condensor. The charging time allotted for the flash condensor Cb and the firing condensor Cz is such that, by the time stepping switch T has advanced to its next step, the flash voltage Ub and the firing voltage Uz will have again built up to their rated or designed values.

The mode of externally triggered firing depicted in FIG. 4 is not the only mode possible. For example, the firing of the flash lamps can be triggered from one of the central stations by abruptly increasing or decreasing or abruptly interrupting the voltage level of the transmitted voltage, with this abrupt change of transmitted voltage level being detected, at each station, by a respective circuit stage responsive to the abrupt voltage-level change.

Externally triggered firing of the flash lamps in a system of the type here in question has the great advantage of assuring that the firing instants of the various flash lamps which flash at the various stations of a selected series of activated stations all be referenced to predetermined instants in time, i.e., be referenced to a common clocking action, and in that way assure that the various firing instants all occur at the proper times and in the intended sequences. Conventionally, in such flashing-lamp highway signalling systems, as explained in the introductory part of this specification, the various firing instants at the activated stations are determined by the states of charge of the stations' storage condensors, i.e., such that the flashing actions occurring at the various stations each be free-running and unsynchronized with one another. The conventional approach is the logical one, if one considers the nature of the display effect to be achieved. After all, it is merely required that flash lamps at the activated stations flash, almost in the sense of a merely decorative effect, for which centralized synchronization would not in itself have any significance. Likewise, inasmuch as successive flashing stations may spaced apart at intervals on the order of one kilometer each, highway drivers will in general anyway be unable to see more than one flashing station at a time, for which reason again the concept of centralized synchronization of the flashing actions occurring at the various stations has not suggested itself. On the contrary, the conventional approach, whereby the flash action occurring at each station is in itself free-running and furthermore entirely unsynchronized with the flash action occurring at other stations, is positively the approach which has hitherto seemed most natural and simplest. However, the problem with the conventional approach, even apart from the more ambitious and complex flashing schedules which the present invention contemplates, resides in the inherent complexity of the multiple-time-constant action which such a system exhibits. Some of the phone stations are located quite near to a central station, and others very remote therefrom. Accordingly, the resistance of the path along which charging energy is supplied to the storage capacitors of differing stations differs greatly as between the nearest and the farthest of such stations. If the three nearest stations are activated for flashing action, then the resistance of the charging-energy transmission paths leading to their storage capacitors is relatively low, but then the length of the transmission path to the farthest one of these three nearest stations may be on the order of three times the distance to the nearest one of these three nearest stations. Likewise, if the farthest three stations are activated for flashing action, the resistance of the charging-energy transmission paths leading to their storage capacitors will be relatively high, but the length of the transmission path to the farthest one of these three farthest stations will not so greatly differ from that of the transmission path to the nearest one of these three farthest stations. This makes for a succession of different time-constants, and depending upon which series of stations is selected out for activation a composite activated-station time-constant which will likewise be variable. Such a network is inherently very complex. In principle, it is possible to provide the storage-condensor circuitry of each station with equalizer and adjuster resistors, dimensioned and/or adjusted such as to equalize the time-constants of the stations all along the succession of stations, although even this is extremely difficult to exactly realize. As a result, when the firing instants are determined by the instantaneous states of charge of the various storage condensors as in prior art, and a series of stations are selected for activation, the one whose storage-condensor circuit has the shortest time-constant will be the first to have its flash lamp fire, i.e., before the flash lamps of the other stations can fire. Then as the storage condensor of the first-fired flash lamp recharges, i.e., before the voltages on the storage condensors of the other stations have finished building up to firing level, the recharging of the first-discharged storage condensor will preferentially draw charging current, either making it impossible for at least some of the other storage capacitors to have their voltages reach firing-level, or unacceptably slowing the reaching of firing-level. Thus, the flash lamps of the other stations of the series of stations selected for activation will not flash at all or will flash with excessively long, irregular and uncontrollable interflash intervals. Even if the confusion and indefiniteness of such a situation is reduced by resort to equalizer and adjuster resistors at each storage-condensor circuit, simple identity of flash-operation characteristics at all the stations does not really result, from several viewpoints. Such attempts at equalization are implemented at the cost of unnecessary power consumption. Furthermore, the compensating circuitry provided at each station will be different and/or differently dimensioned and/or adjusted at different stations, which means that the design of the circuitry for a station cannot be completed until after a determination of what particular station the circuitry is intended for. Likewise, excessive analytical work involved in compensatory design and adjustment, even if considered tolerable at installation time, makes for difficult maintenance and repair work subsequently.

In contrast, the present invention imposes a certain amount of order into the nature of the multiple-time-constant system involved, by causing all flash-lamp ignitions occurring at each station individually, and occurring at all activated stations considered jointly, to occur at instants determined in accordance with a central clocking action. Although this approach does not in itself solve all the difficulties associated with such a multiple-time-constant capacitor-charging system, the degree of order which it does impose is such as to clear the way for the use of various relatively simple compensatory techniques by means of which various individual ones of the remaining sources of difficulty and indefiniteness can be overcome individually, as will be described further below.

In accordance with the present invention, although highway drivers will not in general be able to see more than one station at a time, and although even if they could actual synchronization of the flashing actions occurring at all activated stations would serve no visual or psychological purpose, the centralized clocking action employed in the present invention serves, on the energy-flow level, to prevent the development of uncontrollable phase shifts as among the flashing schedules followed at different ones of the activated stations. As will be explained below with regard to a concrete example, if uncontrollable phase shifts among the schedules followed at different stations were permitted, this could lead to periodic variation in the overall charging action of the system, with periodic inability of some storage capacitors to charge sufficiently.

Figures 5, 6:
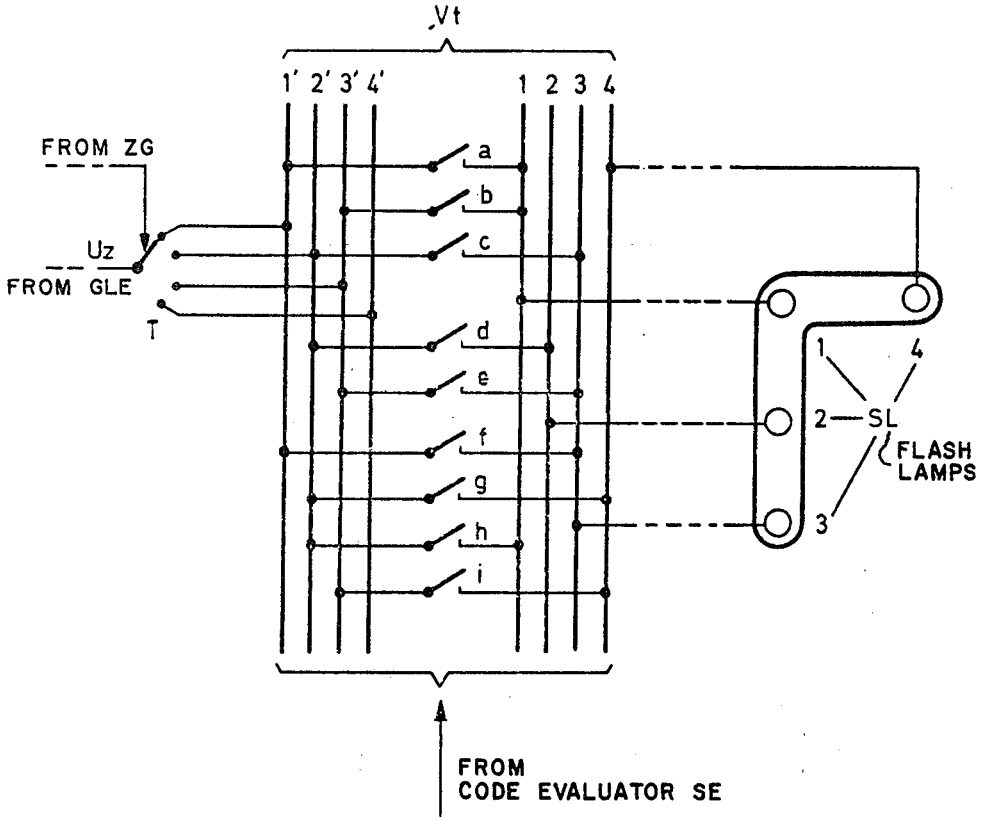
FIG. 5 depicts the internal configuration of the distributor Vt of FIG. 4.
FIG. 6 is a table indicating which switching combinations in FIG. 4 implement which signalling actions in FIG. 3.

FIG. 5 depicts the internal configuration of the distributor Vt of the flash-schedule circuit stage Bfs of FIG. 4. The distributor Vt comprises a set of switching contacts a-i. The switching contacts and the stepping switch T are, for the sake of simplicity, depicted as mechanical switches. However, it will be understood that use of integrated electronic switching circuitry will in general be preferable. Under the control of counting stage ZG, stepping switch T cyclically applies the firing voltage Uz to successive ones of the terminals 1', 2', 3', 4'. Depending upon the flash schedule to be implemented (e.g., NRSI or NRSII or NRSIII in FIG. 3*a* or NRSII' or NRSIII' in FIG. 3*c*), the switching contacts a-i are closed in differing combinations. These combinations are tabulated in FIG. 6, where each dot in the tabulation represents the closing of one of the switching contacts a-i. Which of contacts a-i are to be closed is determined by code-evaluator stage SE, in dependence upon the code signal which it receives, as described further below. Depending upon which switching contacts are closed, firing voltage Uz is transmitted to a particular combination of one or more of signal lamps SL1–4 in a particular sequence.

Figure 7:
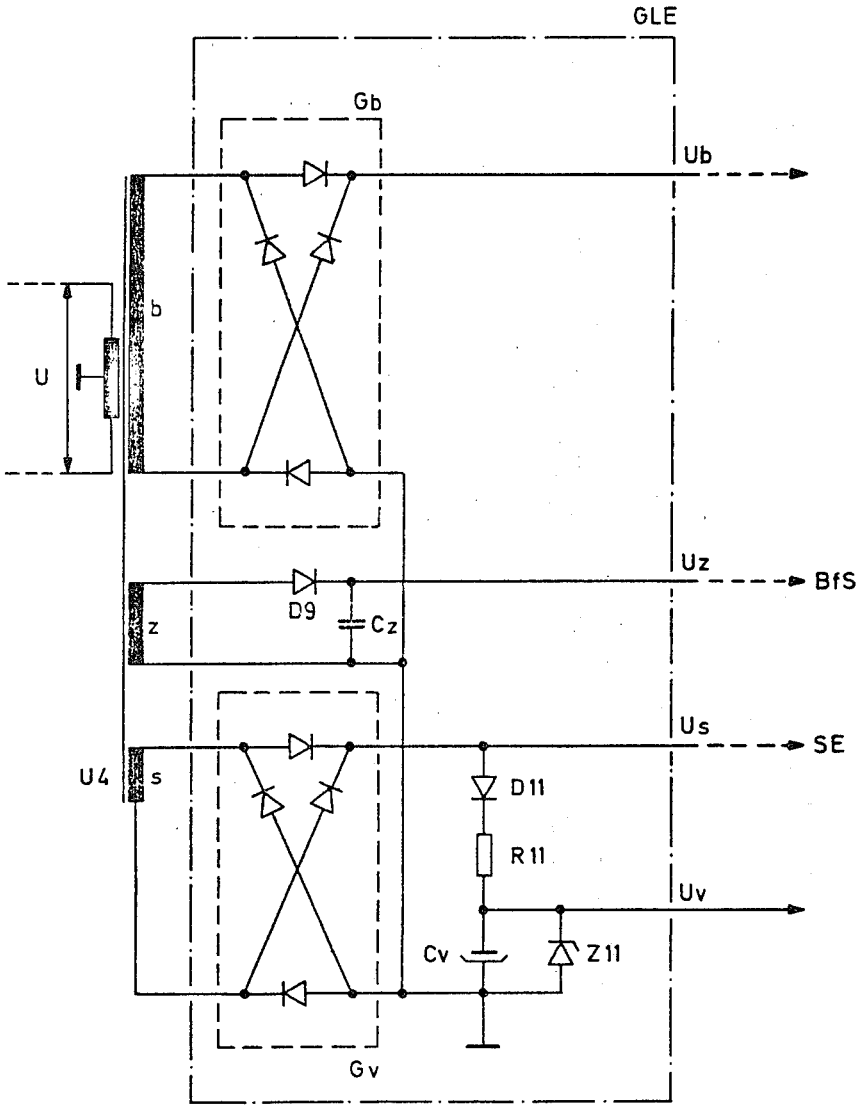
FIG. 7 depicts the internal configuration of the rectifier and charger stage GLE of FIG. 4.

FIG. 7 depicts the internal configuration of the rectifier and charger stage GLE of FIG. 4, operative for furnishing the flash voltage Ub, the firing voltage Uz, the code-signal voltage Us, and operating voltage Uv. The A.C. voltage U abstracted from the phantom circuit is directly stepped up to a level appropriate for flash energization by the secondary winding b of transformer U4, is rectified by a full-wave rectifier Gb, and is transmitted as a rectified but still unfiltered flash voltage Ub. The usual voltage stabilization, employed in the prior art mainly to hold constant the flash-repetition frequency which is to result, is here unnecessary because the firing of flash lamps is, as already indicated, externally triggered and not dependent upon the instantaneous state of charge of the capacitor Cb (see FIG. 4) responsible for storing flash-lamp flash energy.

The firing voltage Uz is derived from the voltage produced by secondary winding z, the latter voltage applied to ignition capacitor Cz via a charging diode D9.

The operating voltage Uv is derived from the voltage produced by secondary winding s, the latter voltage being applied to a full-wave rectifier Gv, and the rectified voltage used to charge current-source capacitor Cv through the intermediary of a charging diode D11 and a charging resistor R11. The operating voltage Uv can, of course, be a relatively low voltage, with secondary winding s dimensioned accordingly.

The code-signal voltage Us is likewise derived from the voltage produced by secondary winding s and rectified by rectifier Gv, and is transmitted to code-evaluator stage SE as already stated. In the exemplary embodiment here disclosed, the code-signal voltage Us is binary, and its constituent "0" and "1" bits are represented by a relatively lower and by a relatively higher voltage level, respectively. Because current-source capacitor Cv will have its charge continually replenished, i.e., during transmission of the two-voltage-level code-signal voltage too, the voltage across current-source capacitor Cv is stabilized by means of a zener diode Z11. Charging diode D11 serves to prevent charge flow from condensor Cv to the evaluating circuitry in code-evaluator stage SE, where it might otherwise introduce misinformation. Resistor R11 serves for decoupling.

The circuit stages SE, Bfs and ZG operating off operating voltage Uv will in general be IC stages, their power consumption accordingly being extremely low compared to that of the actual flash lamps.

Figure 8:
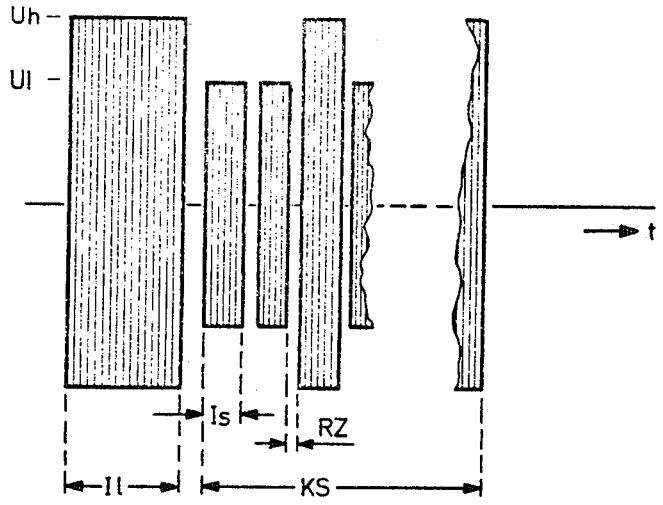
FIG. 8 depicts the form of the pulse-modulated A.C. voltage waveform utilized to activate selected series of stations and to determine the flashing schedules to be implemented at each station of such series.

FIG. 8 depicts as a function of time a representative interval of the pulse-modulated 50-Hz A.C. voltage transmitted by the phantom circuit for the activation of the flash-lamp subsystem of one phone station. The A.C. voltage cycles are represented by the hatching within the rectangular pulses. Keying of the voltage level of the transmitted A.C. voltage is performed at the central station from which the A.C. voltage is transmitted. I1 denotes a capacitor-charging pulse. The duration of charging pulse I1 is longer than the constituent signal pulses Is of the next-following code signal KS. Charging pulse I1 serves to charge the current-source condensor Cv, so that operating voltage Uv be furnished to circuit stages SE, Bfs and ZG, and perhaps other incidentally present circuit stages.

The code signal KS is constituted by A.C.-voltage pulses and is here binary coded. Although there exist a variety of techniques for representing the two logic levels of such a binary code, here the two logic levels are represented by voltage level alone. In particular, the lower voltage level Ul represents the binary state "0", and the higher voltage level Uh represents the binary state "1". Each of these "0" and "1" pulses has a duration lasting for a succession of A.C. voltage cycles. The individual pulses are spaced in time by interpulse intervals RZ. During the interpulse intervals the transmitted A.C. voltage has zero amplitude. These A.C.-voltage pulses of the differing amplitudes Uh and Ul are, as described with respect to FIGS. 4 and 7, applied to transformer U4, and in those two Figures the transformed and rectified versions of them are denoted in common as the code-signal voltage Us.

As already stated with regard to FIGS. 4 and 7, after the transmission of the code signal Us, and the resulting establishment of the blinking schedule to be followed, the blinking schedule commences. The voltage used for this purpose has voltage amplitude Uh.

Figure 9:
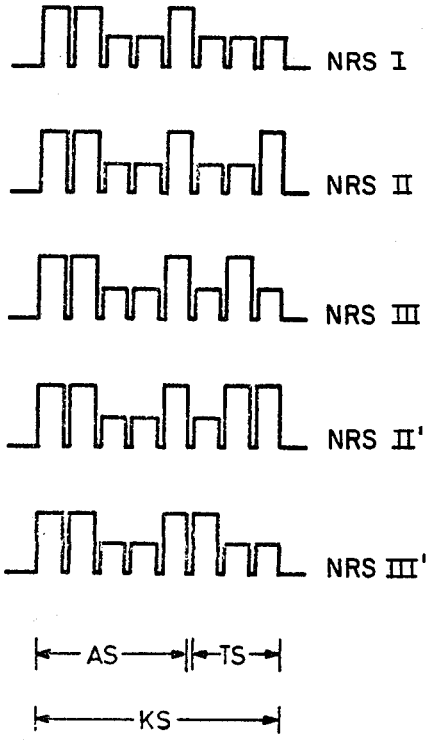
FIG. 9 depicts an example of a coding scheme used to identify which stations are to be activated, and used to identify which blinking schedules are to be followed.

FIG. 9 is a simplified, unipolar representation of five differing code signals KS configured in accordance with a merely exemplary code scheme. The five different code signals shown are all intended for a single one of the succession of emergency-phone stations involved. These five different code signals can be used to select, for the one station associated with these five different code signals, any one of the five different blinking schedules NRSI, NRSII, NRSIII (FIGS. 3*a* and 6), NRSII' and NRSIII' (FIGS. 3*c* and 6). Each code signal KS consists of an address signal AS and a schedule signal TS. The address signal AS is different for each different one of the phone stations. In FIG. 9, the address signal AS consists of five bits. The schedule signal TS determines the number of flash lamps which are to blink and also the sequence in which they are to blink. In the concrete example here given, the schedule signal consists of three bits.

The concrete example here given, in which each code signal KS consists of eight bits, is arbitrarily selected for explanatory purposes. Clearly, the number of bits which will actually be required for the address signal AS will depend upon the total number of emergency-phone stations to be addressed, and the total number of bits required for the schedule signal TS will depend upon the number of different blinking schedules to be made available. In the example depicted in FIG. 9, $2^5=32$ emergency-phone stations can be individually addressed, and $2^3=8$ different blinking schedules can be commanded.

The basic configuration and operation of the system has now been explained. Equally important, however, are considerations of energy transfer. As explained earlier, the greatest difficulty in attempting to implement blinking-lamp highway signalling actions of this type relates to the complexity of the multiple-time-constant capacitor-charging network to be dealt with. Energy-transfer action will now be discussed.

In the inventive highway signalling system, the amount of energy which can be transmitted from one of the central stations to the storage-capacitor circuitry of the most remote one of the phone stations powered from that central station is mainly dependent upon the resistance of the power-transmission path from the central station to that most remote station, the duration of the charging time which can be allotted for capacitor-charging (in turn determined by the minimum blinking frequency needed for a definitely perceivable blinking action), and by the level of power which can be transmitted for capacitor-charging purposes.

The resistance of the power-transmission line from the central station to the most remote phone station is determined by the distance between the two, and by the conductive cross-sectional area of the pairs of conductors available in the cable which has already been laid along the highway.

The duration of the charging time interval which can be allotted for a capacitor-charging operation must take into account the need for a rather fast blinking rate, and in particular the fact that drivers will in general pass the blinking phone station at high travel speed. In general the time interval between successive flashes at a station should not exceed approximately 1–1.5 seconds.

The level of power which can be transmitted for capacitor-charging purposes will in general be determined by the characteristics of the cable already laid along the highway for the succession of emergency-phone stations, and therefore is entirely a given. In any event, a relatively low level of transmittable power will in general be required to conform with safety regulations, i.e., to preclude the possibility of serious injury or death in the case of electrocution.

Now, conventionally, when a condensor is to be charged up to a given voltage, and when the charging resistance R for the condensor and the duration $t_0$ of the available charging time interval are given, the capacitance C of the condensor is so selected such that the resulting time-constant $T=R.C$ be smaller than $t_0$ by a factor of about 5. A condensor will accumulate 99.3% of the maximum charge it can accumulate if allowed to charge for a time equal to five times its charging time-constant.

Among other things, in the preferred embodiment of the invention a larger capacitance value is selected for such storage condensor. This is done, because it is furthermore necessary to deal with the fact that the rate at which energy can be transmitted to the such storage condensor is limited in the type of system here involved.

Figure 10:
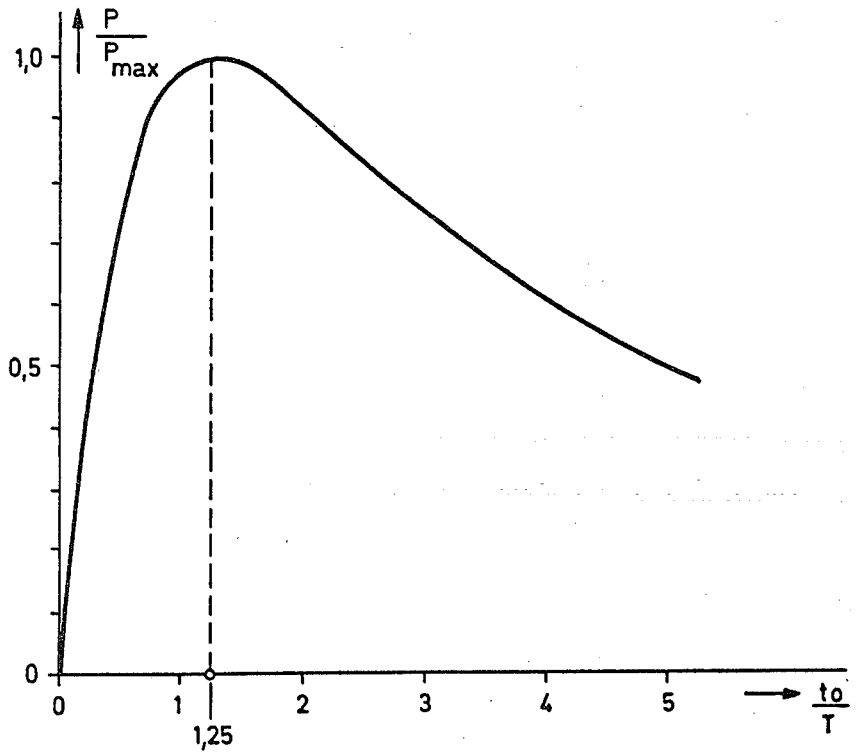
FIG. 10 is a graph of normalized energy transferred to the storage condensors at the individual stations, referred to explain how maximum energy can be transferred despite the various limitations imposed by the existing physical equipment to be utilized and by the charging time intervals dictated by the minimum blinking rate needed for psychological effectiveness.

FIG. 10 depicts the nature of the relationships which this aspect of the present invention exploits. Plotted along the horizontal axis in FIG. 10 are successive values of the ratio of the available charging-time duration $t_0$ to the charging time-constant T of the capacitor-charging circuit. Plotted along the vertical axis is the total amount of energy which the capacitor can accumulate for differing values of $t_0/T$, but normalized with respect to the maximum total amount of energy which the capacitor can thusly accumulate. $t_0$ is, as already stated, virtually a given. As will be seen, the maximum amount of energy which the capacitor can accumulate (i.e., given the fact of predetermined charging time, predetermined charging resistance, and predetermined charging voltage) occurs when the charging time-constant T has a value such that the charging-time duration $t_0$ is a mere 1.25 times such time-constant T. Indeed, the maximum energy which can be thusly accumulated is approximately twice what could be accumulated, within the context of such limitations, using a shorter time constant equal to only one-fifth the available charging-interval duration. Because the curve of FIG. 10 is normalized, the absolute values of the charging-voltage level employed, the charging resistance R, and the charging-interval duration $t_0$ available need not be stated; whatever their values, maximum energy accumulation occurs with $T=t_0/1.25$.

With the charging-interval duration a given (e.g., the interflash interval not to be less than ca. 1–1.5 seconds), the value of the time-constant T follows directly, and to ascertain the value of capacitance C needed for maximum energy accumulation it is merely necessary to divide time-constant T by charging resistance R. However, as explained at several points earlier, the charging resistance for the storage-capacitor circuit of each phone station is different from one station to the next, being determined by the distance from the central station to each such phone station. It is an important practical object of the invention to so design the flash-control circuitry that it be identical at all phone stations, and accordingly the question arises what value of charging resistance R is to be considered when selecting the capacitance value C for all stations identically. Furthermore, if, for example, the system is to operate by activation of a series of three successive stations, such as here assumed for explanatory purposes, it may happen that three such stations are activated on only one side of the highway, or that three such stations are activated on the opposite side of the highway too. In the latter case the total number of capacitors being charged will be twice that in the former case.

It is presently preferred to proceed on a worst-case basis. It is accordingly assumed that $2\times3=6$ capacitances are to be charged simultaneously, these together presenting a total capacitance $C_{ges}$. Furthermore, it is assumed that the resistance R of the charging path leading to this total capacitance $C_{ges}$ is the resistance of the longest charging path which might arise, i.e., the resistance of the charging path leading to the last phone station in the succession of stations supplied by a central station.

The latter assumption is accurate only for one of the six capacitances, inasmuch as the charging paths leading to the other five will be shorter. Accordingly, the charging resistances of the other five capacitances will lower, and their actual charging time-constants T' will be shorter than assumed. If, for example, the system is to operate by activation of a series of three successive stations, such as here assumed for explanatory purposes, it may happen that three such stations are activated on only one side of the highway, or that three such stations are activated on the opposite side of the highway too. In the latter case the total number of capacitors being charged will be twice that in the former case.

Because the charging time-constants for these other five capacitances are shorter, and in particular shorter due to a lower value of R and not due to a lower value of C, both the amount of energy accumulated by them and the voltage to which they will have charged at the end of the charging time interval $t_0$ will be higher than for the capacitance of the most distant station, i.e., unless some countermeasure can be developed.

These higher voltages and higher amounts of accumulated energy would cause the flash lamps of the nearer phone stations to flash with higher intensity and furthermore place greater demands upon these nearer flash lamps, leading to a shorter lifetime for the nearer flash lamps than for the ones more remote.

The development of excessive amounts of accumulated energy and excessive capacitor voltage would likewise result, in a way simpler to understand when, although the system is designed on the worst-case basis for simultaneous activation of six stations, only three stations are activated because the hazard to be warned of applies to only one direction of traffic.

In accordance with the present invention, the development of excessive voltage and excessive stored energy is prevented, by interrupting the charging of each storage capacitor as soon as its voltage has built up to a predetermined value, the predetermined value being the value for which the storage capacitor of the most remote station has been designed for the case of three stations activated on each side of the highway.

Figure 11:
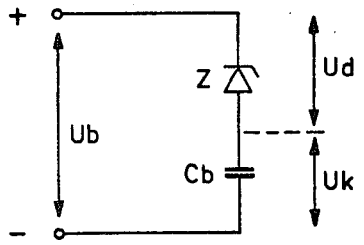
FIG. 11 depicts the circuitry with which each storage condensor is provided to limit the amount of energy it can accumulate in preparation for a flash.

FIG. 11 depicts a merely exemplary embodiment of a circuit configuration for thusly interrupting the charging of the storage or flash capacitors Cb. The charging D.C. voltage involved, i.e., the flash voltage Ub, is applied across flash capacitor Cb with a zener diode Z connected in series with Cb to oppose the charging voltage. The breakdown voltage Ud of zener diode Z is equal to the difference between the applied charging voltage Ub and the predetermined voltage value Uk at which charging is to be discontinued.

When flash capacitor Cb is in entirely or almost entirely discharged state, the voltage drop applied across the zener diode is $(Ub-Uk')>Ud$, Uk' being the instantaneous (and increasing) voltage across capacitor Cb. Accordingly, diode Z is able to transmit charging current and charge capacitor Cb until $Uk'=Uk$, i.e., until $Ub-Uk=Ud$. The voltage drop across zener diode Z then becomes insufficient to maintain it conductive, and the zener diodes becomes non-conductive. Even though the non-conductive-state resistance of the zener diode is not infinite, its resistance when non-conductive will be sufficiently high to prevent any further substantial charging of flash capacitor Cb during the remaining part of the time interval leading to firing.

Compared with prior-art provision of compensatory resistors in an attempt to equalize the charging time-constants of the storage capacitors of the differently distant stations, the charge-interruption technique utilized in accordance with this concept of the invention provides a number of important advantages:

(a) The circuitry with which each phone station is provided is the same as that with which all the other phone stations are provided. Accordingly, each station's circuitry is interchangeable with that of any other one of the succession of stations. In great contrast, if each station's storage-capacitor circuitry is provided with equalization resistors, such interchangeability would not at all exist.

(b) No matter what series of three (or three plus three) consecutive stations is activated, the amount of accumulated charge at each station will always be the same. Furthermore, this is achieved entirely without the sort of extensive adjustment work which has hitherto been necessary even in considerably simpler flashing-light highway signalling systems.

(c) The avoidance of equalizer or adjuster resistors eliminates the wasteful power consumption associated with them. When an equalizer resistor is incorporated into the storage-condensor circuitry of a station merely to increase its charging resistance up to the value corresponding to the most distant station, the flow of charging current through such a resistor inherently wastes considerable amounts of power. Another power saving results from the fact that charging current ceases to be drawn by successively more distant storage capacitors as each of these in turn reaches the predetermined voltage level. This enables the more distantly located storage capacitors to draw more charging current than would otherwise be possible, and thus shortens the time required to charge the most distant capacitors, too. This makes it possible to shorten the charging time, and thereby increase the flash rate, which is of great importance for achievement of the end result sought, i.e., a blinking action highly noticeable especially to high-speed drivers. Alternatively, if the interflash interval is not to be shortened, it becomes possible to accumulate larger amounts of stored energy on the capacitors and therefore use brighter flash lamps.

In the case of the phone station located closest to the central station from which power is supplied, the charging resistance may be so low as to result in excessive charging current, e.g., if the closest station happens to be quite close to the central station. In that event, use might be made of a current-limiting resistor connected in circuit with the storage capacitor of that station. It will be understood that a mere current-limiting resistor of such type does not serve the purpose of the prior-art equalizer or adjuster resistors in question; indeed such current-limiting resistor will often do nothing to even approximate to an equalization between its associated time-constant and the time-constants of the next-following phone stations.

Figure 12A:
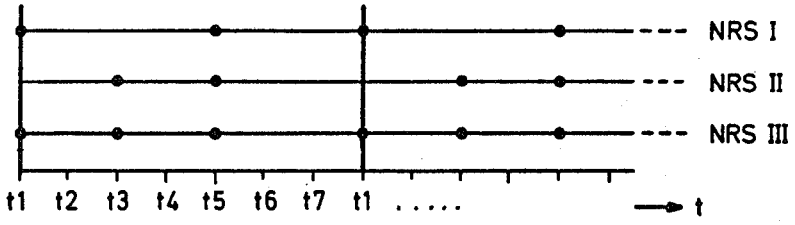
FIGS. 12*a*-12*c* are firing-versus-time diagrams, referred to explain certain problems created by the multiple-time-constant network involved, and the means whereby to deal with these problems.
Figure 12B:
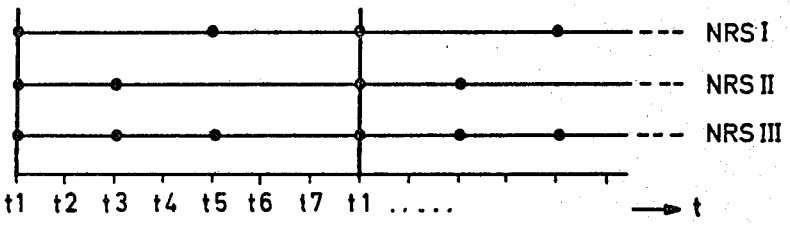
Figure 12C:
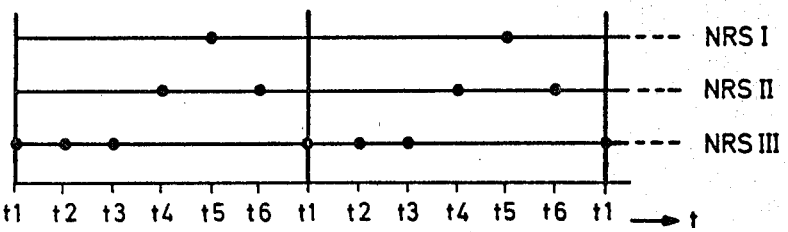

FIGS. 12*a*–12*c* are further ignition-versus-time diagrams, referred to explain additional considerations relating to charging-time problems.

FIG. 12*a* depicts a modified version of the blinking schedule diagrammed in FIG. 3*a*. In FIG. 12*a*, the blinking schedule followed at each of the three stations has a character similar to that of each of the three blinking schedules involved in FIG. 3*a*, but the phase relationships of each of the three blinking schedules, one to another, are altered, such that the charging time allotted for each capacitor-recharging operation takes into account the number of capacitors which have just been fired and need to be recharged. At time t1, two flash lamps are fired, one at station NRSI and the other at station NRSII. Before any further lamps are fired, two clock intervals, i.e., t1 to t2, and then t2 to t3, are allotted for the recharging of the two associated flash capacitors. At time t3, two lamps are again fired, one at station NRSII and the other at station NRSIII. Before any further lamps are fired, two clock intervals, i.e., t3 to t4, and then t4 to t5, are allotted for the recharging of the two associated flash capacitors. At time t5, three lamps are fired, one at each of the three activated stations. Before any lamps are fired again, now three clock intervals are allotted for the recharging of the three associated flash capacitors.

This matching of the charging-interval durations to the number of flash lamps fired at any given time has nothing whatsoever to do with the individual flash schedules followed at the individual stations involved. I.e., the duration of the successive recharging intervals is not the same as the interflash intervals occurring at the three stations considered individually. E.g., after a lamp at station NRSI is fired at time t1, the time allotted for recharging of the associated storage capacitor is equal to two clocking intervals, but the firing of a flash lamp does not again occur at this station until a further two clocking intervals have passed. Although one lamp ignition occurs at station NRSI at time t1 and the next ignition at that station does not occur until time t5, the completion of the recharging of the storage capacitor at this station by time t3 is of importance. At time t3 two lamps at two other stations are fired, and their storage capacitors become discharged. When the storage capacitors of these two other stations begin to charge, because their state of charge is low, they will strongly draw charging current. If, at time t3, the recharging of the storage capacitor at station NRSI were not yet completed, the amount of charging current diverted by the two recently discharged capacitors would greatly slow the completion of the recharging of the capacitor at station NRSI, if not make impossible the completion of the recharging of that capacitor.

Thus, the recharging of capacitors can be performed with an extreme degree of certainty, by establishing appropriate phase interrelationships as among the three different blinking schedules followed at the three stations activated, and without loss of the character of the blinking schedule followed at each station considered individually. So direct and straightforward a solution to the problem of recharging the capacitors of such a multiple-time-constant capacitor-charging network is made possible by the inventive concept of referencing all ignition moments at all activated stations to a central clocking action. With the recharging actions now all so predetermined and definite in character, the system can be readily dimensioned for the storage of rather high amounts of flash energy, with complete safety and reliability.

In order that this phase correlation as among the individual blinking schedules followed at the individual stations be established, one can, by way of example, follow the transmission of the code signal which activates the selected stations and establishes their flash schedules with a start signal operative for resetting the counting stages ZG at each of these stations, to assure that a definite initial phase interrelationship be established. For example, the start signal can be an encoded signal, with each counting stage ZG provided with a respective code-evaluator stage which responds to the start-code signal by resetting the counting stage, alternatively, the start signal can be constituted by a simple boost in the amplitude of the A.C. voltage transmitted from the central station, for example, in the manner disclosed in my simultaneously filed application entitled 'blinking signal-light system, especially for a series of emergency-phone stations distributed along the length of a high-way, or the like', the entire disclosure of which is incorporated herein by reference.

If resort is not had to the technique of FIG. 12*a*, i.e., according to which the charging time allotted after the firing of one or more flash lamps depends upon the number of flash lamps just fired, then it would become necessary to resort either to longer interflash intervals or to employ lowered levels of flash energy. This will be explained with regard to FIG. 12*b*. In FIG. 12*b*, the flash schedule followed at each station, considered in isolation, is identical to that in FIG. 12*a*, but the flash schedule followed at station NRSII has been shifted in phase relative to those followed at stations NRSI and NRSIII. At time t1 three lamps are fired, but the charging time allotted until the next firing of lamps at t3 is equal to only two clocking intervals, which is too short if the storage capacitors are to be recharged to the same voltage level as can be employed in FIG. 12*a*. Likewise, at time t5, only two lamps are fired, but three clocking intervals are allotted for recharging preliminary to the next firing of lamps at t1, which is longer than necessary. If the same energy is to be accumulated as in FIG. 12*a*, then in FIG. 12*b* it would be necessary to increase the length of the base or clocking interval, and as a result inherently lower the blinking frequencies.

FIG. 12*c*, like FIG. 12*a*, depicts a phase interrelationship as among three blinking schedules such that the charging time allotted after the firing of one or more flash lamps depends upon the number of flash lamps just fired. In FIG. 12*c*, this approach is pushed to an extreme, in the sense that never more than one flash lamp is to be fired during any given clocking interval. Accordingly, the charging time allotted after each lamp ignition is always equal to one clocking interval. The blinking schedules employed in FIG. 12*c* are made similar to those of FIG. 12*a*, the criterion for similarity being that the longest interflash interval occurring at each single station in FIG. 12*c* be at least approximately the same as in FIG. 12*a*. Whereas the shortest charging time needed with the phase interrelationships of FIG. 12*a* is equal to two clocking intervals, each allotted charging time in FIG. 12*c* is reduced to half that duration.

Although the alternative approach of FIG. 12*c* is possible, it is to be noted that, from the viewpoint of the transient response of the capacitor-charging network, it is more advantageous to have longer charging times. Accordingly, it is preferable to charge a plurality of condensors simultaneously as in FIG. 12*a* but during a longer time interval, than to charge single capacitors one-at-a-time using a shorter time interval as in FIG. 12*c*.

The charge-interruption technique of FIG. 11 also brings about a further advantage. When switching over from three-plus-three activated stations (i.e., at both sides of the highway) to three activated stations (i.e., at only one side of the highway), no special countermeasures need be taken to keep the amount of flash energy available to each flash lamp constant. The flash capacitors Cb are dimensioned on a worst-case basis, and therefore have no difficulty in dealing with the three-plus-three mode of operation, and the charge-interrupt action of FIG. 11 assures that, after the changeover, the amounts of flash energy which accumulate on the individual flash capacitors remaining in operation will not be so great as to overload these remaining flash lamps.

It will be understood that each of the elements described above, or two or more together, may also find a useful application in other types of circuits and constructions differing from the types described above.

While the invention has been illustrated and described as embodied in a highway signalling system which makes use of a succession of emergency-phone stations in particular, and which furthermore provides for a particular set of flash schedules involving selected groups of three successive stations at one or both sides of the highway, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A signalling system for controlling flash-lamp stations which are distributed along highways and the like, comprising: a plurality of flash-lamp stations each including at least one flash lamp which is to be made to blink according to a blinking schedule; a like plurality of storage capacitor means, each associated with a corresponding one of the flash-lamp stations and operating in a manner that each storage capacitor means provides power to a corresponding at least one flash lamp and can be recharged by operating power; a transmission circuit linking the flash-lamp stations; a control station connected to the transmission circuit and supplying operating power and control signals thereto, whereby all flash lamps are powered and made to blink according to the blinking schedule, the central station operating in a manner that the operating power has a greater magnitude than has the control signals; and a timer establishing the blinking schedule in a manner that recharging of the storage capacitor means and blinking of flash lamps takes place according to a predetermined interrelationship.

2. The system defined by claim 1, wherein the timer includes a plurality of timing circuits, each timing circuit corresponding to a flash-lamp station and flashing all flash lamps therein in accordance with the control signals.

3. The system defined by claim 2, wherein AC voltage having a period is transmitted along the transmission circuit and wherein the timing circuits respond to said period and flash the flash lamps in accordance therewith.

4. The system defined by claim 3, wherein each timing circuit includes a counter counting periodic intervals in the AC voltage.

5. The system defined by claim 1, further including a limiter at each flash-lamp station, each limiter limiting energy storage in a corresponding storage capacitor means to a predetermined amount of charge.

6. The system defined by claim 5, wherein each limiter discontinues charging of its corresponding storage capacitor means after the predetermined amount of charge has been accumulated therein while failing to flash said at least one flash lamp.

7. The system defined by claim 1, wherein each flash-lamp station further includes a firing means for firing said at least one flash lamp independently of charge accumulation in the corresponding storage capacitor means.

8. The system defined by claim 1, wherein when a predetermined maximum number of flash-lamp stations are simultaneously charged during a time $t_o$, and when a flash-lamp station which is most distant from the central station presents a charging resistance R which opposes recharging of its storage capacitor means, and when each storage capacitor means has a capacitance C, and when a total capacitance $C_{ges}$ is formed by said predetermined number of flash-lamp stations, C is selected such that $$0.5 \leqq [t_o/(R \cdot C_{ges})] \leqq 3.$$

9. The system defined by claim 8, wherein C is selected such that $$t_o/(R \cdot C_{ges}) \simeq 1.25.$$

10. The system defined by claim 1, wherein the blinking schedule is so selected as to leave interflash intervals between blinks of flash lamps, during which interflash intervals a plurality of storage capacitor means can simultaneously recharge, the interflash intervals being longer when said plurality increases and shorter when said plurality decreases.

11. The system defined by claim 10, wherein interflash interval length is variable during operation of the system.

12. The system defined by claim 1, wherein the blinking schedule is so selected as to leave interflash intervals between blinks of flash lamps, during which interflash intervals one and only one storage capacitor means can recharge by itself, all such interflash intervals having identical and constant durations.

13. The system defined by claim 1, wherein the timer includes a cyclical timer circuit located at each flash-lamp station, which cyclical timer circuit responds to a start signal transmitted along the transmission circuit by assuming a predetermined starting state, whereby a predetermined phase interrelationship between operations of the cyclical timer circuits is established.

14. The system defined by claim 1, further including a zone diode in each flash-lamp station which is connected to the storage capacitor means therein and which limits energy stored in the storage capacitor means.

* * * * *